US005283221A

United States Patent [19]

Inobe

[11] Patent Number: 5,283,221

[45] Date of Patent: Feb. 1, 1994

[54] COPYING TACK PAPER FOR THERMAL PRINTER

[75] Inventor: Kazuhiko Inobe, Yokohama, Japan

[73] Assignee: Matsushita Electric Industrial Co. Ltd., Osaka, Japan

[21] Appl. No.: 915,305

[22] Filed: Jul. 20, 1992

[30] Foreign Application Priority Data

Jul. 24, 1991 [JP] Japan ..... 3-184404

[51] Int. Cl.[5] ..... B41M 5/40

[52] U.S. Cl. ..... 503/204; 503/206; 503/226

[58] Field of Search ..... 427/150-152; 428/195, 198; 503/204, 206, 226

[56] References Cited

U.S. PATENT DOCUMENTS 4,768,810 9/1988 Mertens ..... 428/202

*Primary Examiner*—Pamela R. Schwartz

[57] ABSTRACT

An upper thermo-sensitive paper is coated with an adhesive agent on a part of the rear surface thereof, and a lower thermo-sensitive paper is coated with a release agent on the upper surface thereof at the area corresponding to the adhesive agent coated area of said upper thermo-sensitive paper. The upper thermo-sensitive paper is laid on and adhered to the lower thermo-sensitive paper. By separating the upper thermo-sensitive paper from the lower thermo-sensitive paper at the boundary plane between the adhesive agent layer and the release agent layer, the upper thermo-sensitive paper can be used as a tack paper and the lower thermo-sensitive paper can be used as a copying paper.

4 Claims, 6 Drawing Sheets

COPYING TACK PAPER FOR THERMAL PRINTER

BACKGROUND OF THE INVENTION

The present invention relates to a copying tack paper for a thermal printer serving as a data output device.

Heretofore, a thermal printer serving as a data output device of a computer has a thermal head for printing by use of its heat.

There has been used various papers in a thermal printer, for example, a so-called 2P paper as shown in FIG. 5, a tack paper including an adhesive layer on its rear surface as shown in FIG. 6, and so on.

The 2P paper is composed of two thermo-sensitive papers a and b laid one upon another. When the thermal head c is activated for printing, the two thermo-sensitive papers a and b are color developed at the same time and then, separated from each other. In a tack paper type, a plurality of tack papers e are adhered to a ground paper d with certain intervals between the papers, and, after printed by use of a thermal head c, are separated from the ground paper and adhered to desired areas for use.

As to the above-mentioned 2P paper, there are two kinds of papers, namely a paper comprising two thermo-sensitive papers a and b laid one upon another as shown in FIG. 7, and a paper of thermo-sensitive paper plus transfer paper type comprising a thermo-sensitive paper f and a transfer paper g laid one upon another with a transfer ink h composed of carbon interposed therebetween.

In the above-mentioned 2P paper as shown in FIG. 7, when the thermal head c is activated for applying heat, both of the two thermo-sensitive papers laid one upon another react to the heat, whereby the thermo-sensitive papers a and b are color developed.

In the paper of the above-mentioned 2P paper as shown in FIG. 8, when the upper thermo-sensitive paper f is applied with heat by the thermal head c, the upper thermo-sensitive paper is color developed due to the heat, and at the same time, the transfer ink on the rear surface of the thermo-sensitive paper f is melted and transferred to the copying paper g.

In the above-mentioned tack paper, as shown in FIG. 9, a tack paper e composed of a thermo-sensitive paper is adhered to a ground paper d with an adhesive agent layer i and a release agent layer j interposed therebetween, and, after printed by use of the thermal head c, is separated from the ground paper d, and then, may be adhered to another area.

Each of the above-mentioned conventional 2P paper and tack paper is structured for an exclusive use, thereby making it impossible to use a 2P paper as a tack paper, or, vice versa, a tack paper as an usual copying paper.

In other words, there are disadvantages that, when a tack paper is used as a copying paper, it is required to prepare desired number of tack papers, thereby causing a poor productivity, and when a 2P paper is used as a tack paper, it is required to use an adhesive agent for adhesion of the paper after printed.

SUMMARY OF THE INVENTION

An object of the present invention is to overcome the above-mentioned disadvantages of prior arts, and to provide a copying tack paper for a thermal printer which can be used as a copying paper as well as a tack paper.

For achieving the above-mentioned object of the present invention, there are provided various copying tack papers as follows:

1) A copying tack paper in which an upper thermo-sensitive paper coated with an adhesive agent on a part of the rear surface thereof is laid on and adhered to a lower thermo-sensitive paper coated with a release agent on the upper surface thereof at the area corresponding to the adhesive coated area of the upper thermo-sensitive paper.

2) A copying tack paper in which an upper thermo-sensitive paper is coated with a transfer agent on the rear surface thereof; the transfer agent layer is partly coated with an adhesive agent; and the upper thermo-sensitive paper is laid on and adhered to a lower copying paper coated with a release agent on the upper surface thereof at the area corresponding to the adhesive coated area of the upper thermo-sensitive paper.

3) A copying tack paper in which an upper thermo-sensitive paper coated with an adhesive agent on a part of the rear surface thereof is laid on and adhered to an intermediate thermo-sensitive paper coated with a release agent on the upper surface thereof at the area corresponding to the adhesive coated area of the upper thermo-sensitive paper, and the intermediate paper is coated with an adhesive agent on the rear surfaced thereof and laid on and adhered to a ground paper coated with a release agent on the upper surface thereof.

4) A copying tack paper in which an upper thermo-sensitive paper is coated with a transfer agent on the rear surface thereof; the transfer agent layer is partly coated with an adhesive agent; and the upper thermo-sensitive paper is, laid on and adhered to a copying paper coated with a release agent on the upper surface thereof at the area corresponding to the adhesive coated area of the upper thermo-sensitive paper; and the copying paper is coated with an adhesive agent on the rear surface thereof and laid on and adhered to a ground paper coated with a release agent on the upper surface thereof.

By virtue of the above-mentioned arrangements, there is provided a copying tack paper serving as a copying paper as well as a tack paper. As a result, it is not required to prepare a copying paper and a tack paper separately from each other, and a copying paper and a tack paper are color developed at the same time, thereby improving the printing efficiency.

DESCRIPTION OF THE PREFERRED EMBODIMENTS

The present invention will be described below in detail by referring to FIGS. 1 to 4.

Figure 1A:
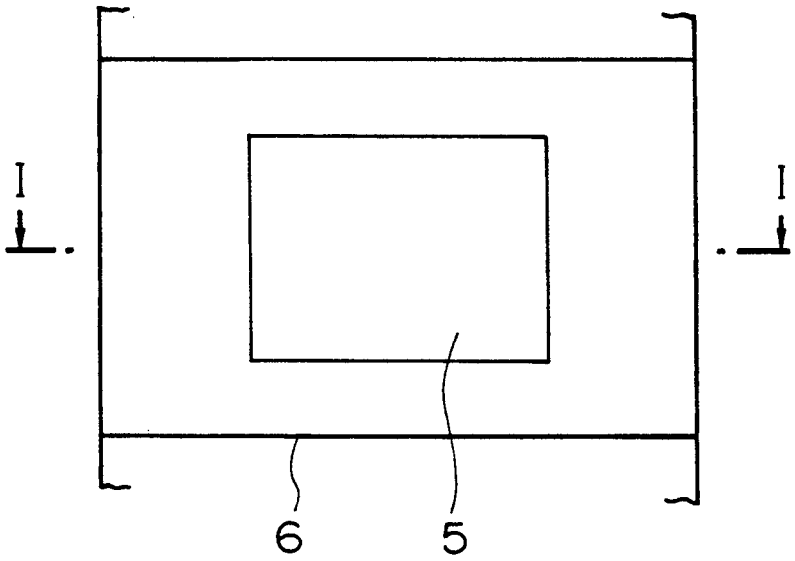
FIG. 1A is a plan view of a copying tack paper according to a first embodiment of the present invention.
Figure 1B:
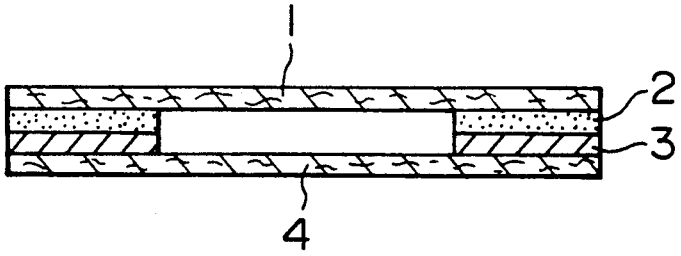
FIG. 1B is a sectional view taken along line I—I of FIG. 1A.

FIGS. 1A and 1B show a first embodiment of the present invention, in which numeral 1 denotes a thermo-sensitive paper, numeral 2 an adhesive agent, numeral 3 a release agent, and numeral 4 a thermo-sensitive paper.

In the first embodiment, the upper thermo-sensitive paper 1 is coated with an adhesive agent 2 on the rear surface thereof at an adhesive coated region 6 excluding a central printing region 5 and also coated with a silicon release agent 3 at a region a little wider than the adhesive coated region 6, and laid on the lower thermo-sensitive paper 4 with these adhesive agent 2 and the release agent 3 interposed therebetween.

The adhesive region 6 is not necessarily required to extend over the whole periphery of the printing region 5, but may be arranged only front and rear or left and right of the printing region.

In this first embodiment, when the printing region 5 of the copying tack paper is color developed by heat of the thermal head, the heat is transferred from the upper thermo-sensitive paper 1 to the lower thermo-sensitive paper 4, thereby color developing both of the thermo-sensitive papers 1 and 4 as achieving printings on these papers 1 and 4.

By separating the two printed thermo-sensitive papers 1 and 4 from each other at the boundary plane between the adhesive agent layer 2 and the release agent layer 3, the upper thermo-sensitive paper 1 can be used as a tack paper because it is coated with an adhesive agent on the rear surface thereof, and the lower thermo-sensitive paper 4 can be used as a copying paper.

Figure 2A:
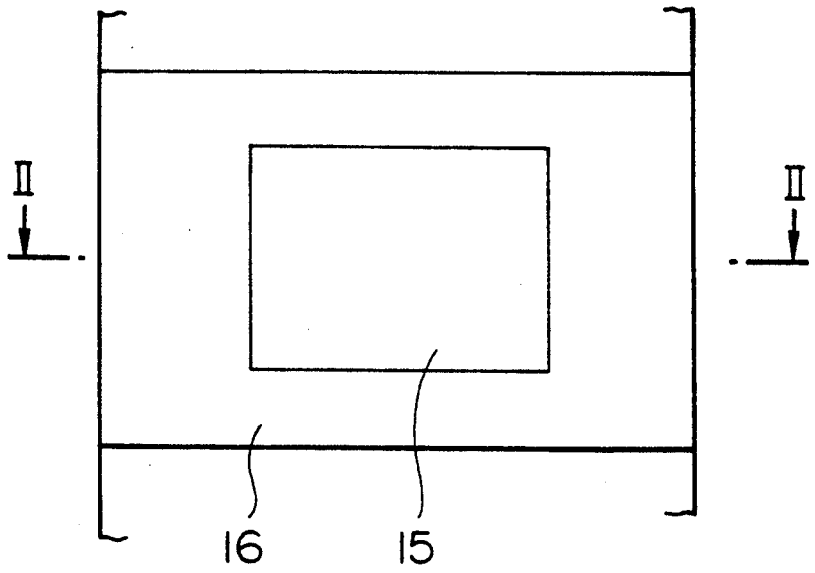
FIG. 2A is a plan view of a copying tack paper according to a second embodiment of the present invention.
Figure 2B:
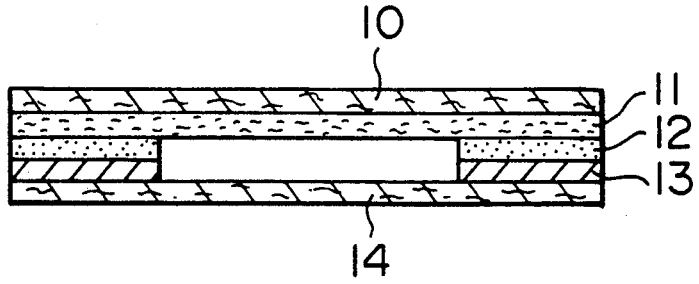
FIG. 2B is a sectional view taken along line II—II of FIG. 2A.

FIGS. 2A and 2B show a second embodiment of the present invention, in which numeral 10 denotes a thermo-sensitive paper, numeral 11 a transfer ink, numeral 12 an adhesive agent, numeral 13 a release agent, and numeral 14 a copying paper.

The upper thermo-sensitive paper 10 is coated with a transfer ink on the whole rear surface thereof and with an adhesive agent 12 and a release agent 13 on the adhesive coated region 16 excluding the printing region 15.

In this second embodiment when the printing region 15 of the copying tack paper is color developed by heat of the thermal head 15, the upper thermo-sensitive paper 10 is color developed, and the transfer ink is melted and transferred to the copying paper 14, thereby achieving printing actions on the thermo-sensitive paper 10 and the copying paper 14 at the same time.

By separating the printed thermo-sensitive paper 10 and the copying paper 14 from each other at the boundary plane between the adhesive agent layer 12 and the release agent layer 13, the thermo-sensitive paper 10 can be used as a tack paper and the copying paper 14 can be used as a copying paper.

Figure 3A:
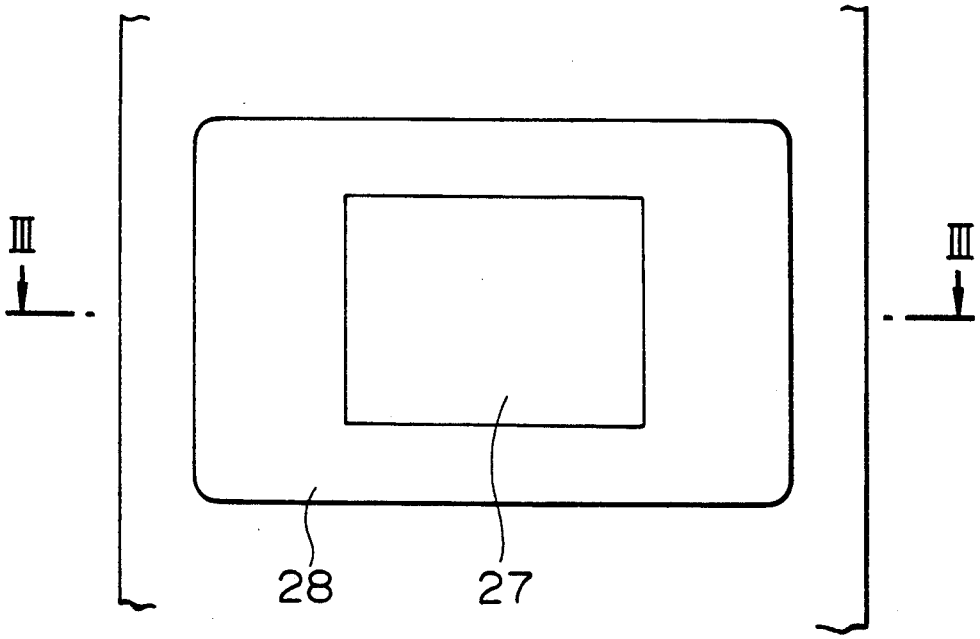
FIG. 3A is a plan view of a copying tack paper according to a third embodiment of the present invention.
Figure 3B:
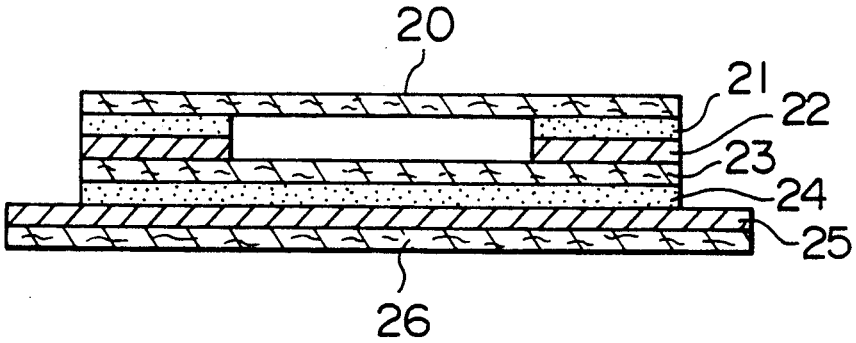
FIG. 3B is a sectional view taken along line III—III of FIG. 3A.

FIGS. 3A and 3B show a third embodiment of the present invention, in which numeral 20 denotes a thermo-sensitive paper, numeral 21 an adhesive agent, numeral 22 a release agent, numeral 23 a thermo-sensitive paper, numeral 24 an adhesive agent, numeral 25 a release agent and numeral 26 a ground paper.

The upper thermo-sensitive paper 20 is coated with an adhesive agent 21 and a release agent 22 on its rear surface at the adhesive region 28 excluding the printing region 27, and is laid on an intermediate thermo-sensitive paper 23 with the adhesive agent 21 and the release agent 22 interposed therebetween.

The intermediate thermo-sensitive paper 23 is coated with an adhesive agent 24 on the whole rear surface thereof and by the help of which the above-mentioned thermo-sensitive papers 20 and 23 are adhered to the ground paper 26 which is coated with a release agent 25 on its upper surface.

In this third embodiment, when the printing region 27 of the copying tack paper is applied by heat of the thermal head, the upper and intermediate thermo-sensitive papers 20 and 23 are color developed or printed.

By separating the printed upper thermo-sensitive paper 20 from the intermediate thermo-sensitive paper 23 at the boundary plane between the adhesive agent layer 21 and the release agent layer 22, the thermo-sensitive paper 20 can be used as a tack paper, and by separating the intermediate thermo-sensitive paper 23 from the ground paper 26 at the boundary plane between the adhesive agent layer 24 and the release agent layer 25, the intermediate thermo-sensitive paper 23 can be also used as a tack paper.

Figure 4A:
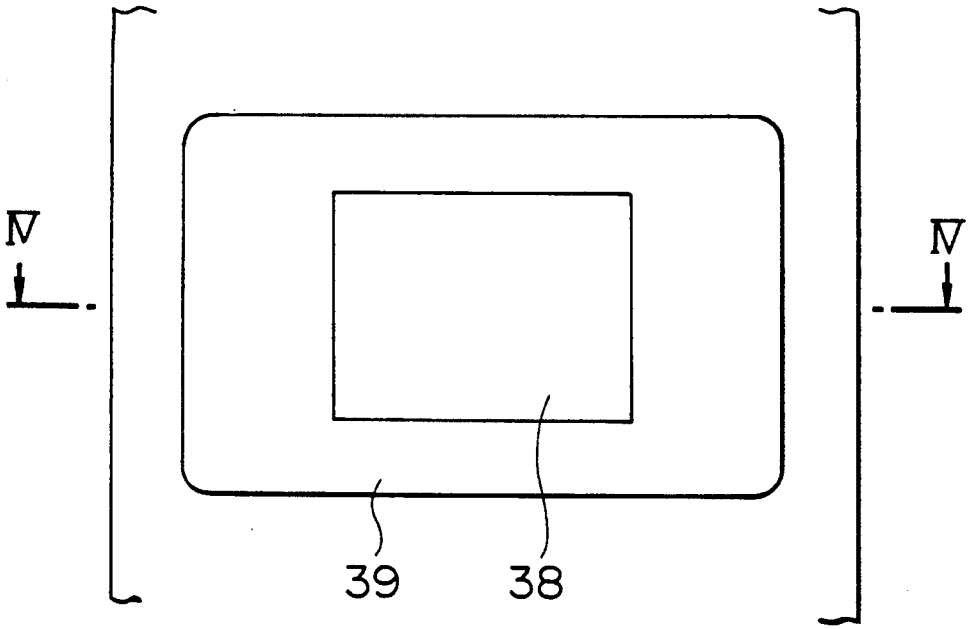
FIG. 4A is a plan view of a copying tack paper according to a fourth embodiment of the present invention.
Figure 4B:
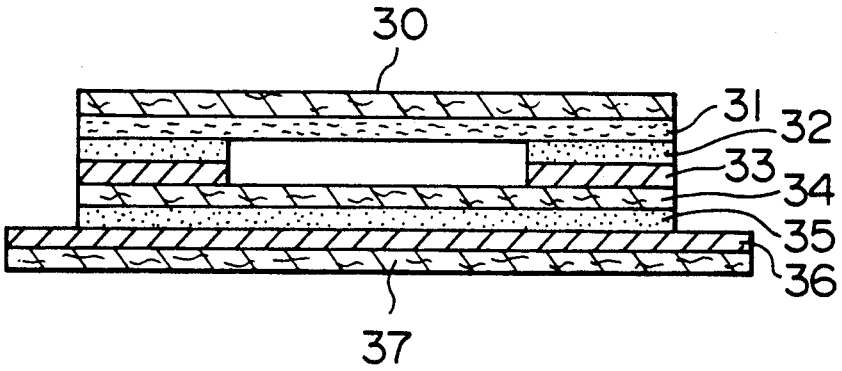
FIG. 4B is a sectional view taken along line IV—IV of FIG. 4A.
Figure 5:
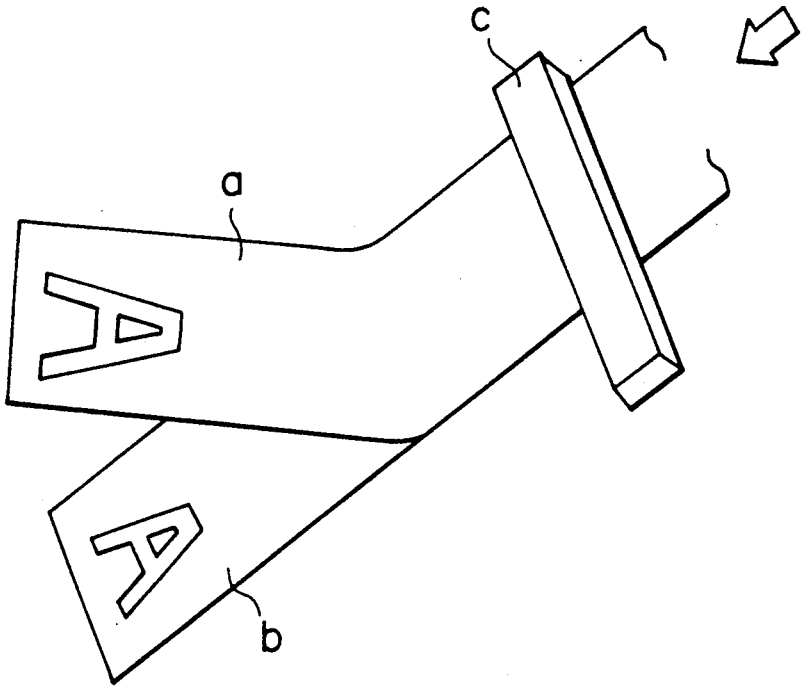
FIG. 5 PRIOR ART
FIG. 5 is a perspective view of a conventional 2P paper.
Figure 6:
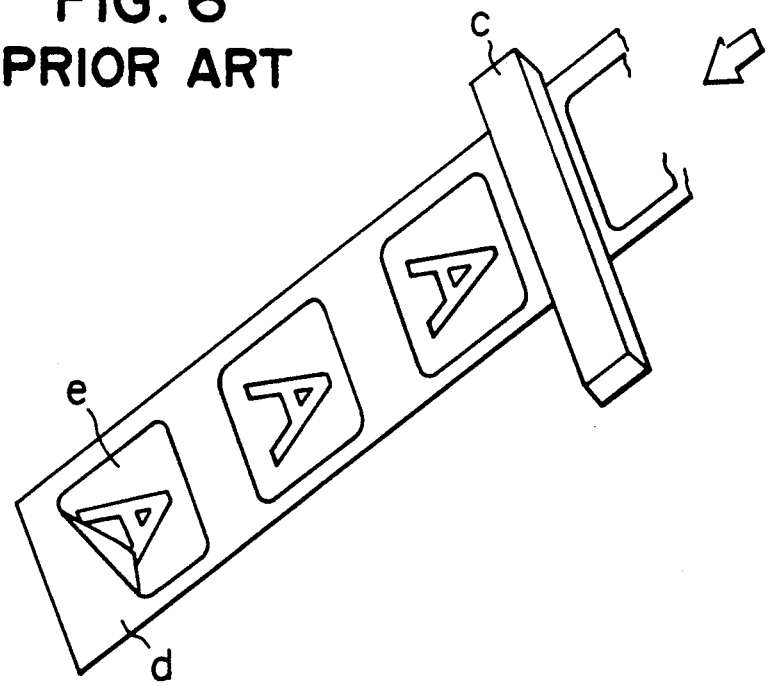
FIG. 6 PRIOR ART
FIG. 6 is a perspective view of a conventional tack paper.
Figure 7:
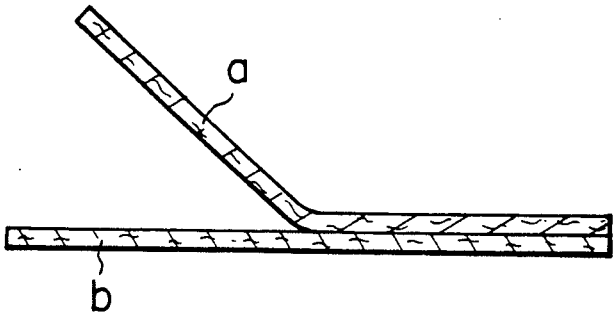
FIG. 7 PRIOR ART
FIG. 7 is a perspective view of a conventional 2P paper.
Figure 8:
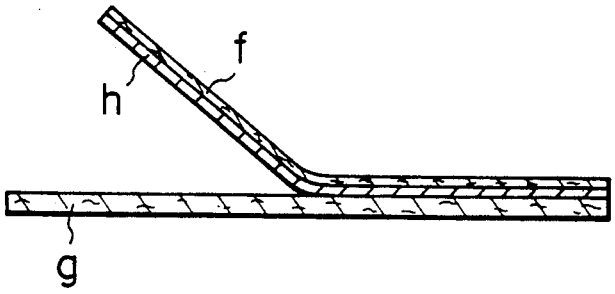
FIG. 8 PRIOR ART
FIG. 8 is a perspective view of a conventional 2P paper.
Figure 9:
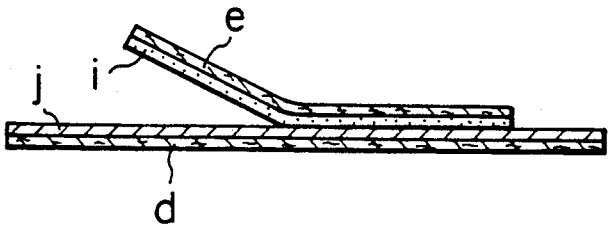
FIG. 9 PRIOR ART
FIG. 9 is a perspective view of a conventional tack paper.

FIGS. 4A and 4B show a fourth embodiment of the present invention, in which numeral 30 denotes a thermo-sensitive paper, numeral 31 a transfer ink, numeral 32 an adhesive agent, numeral 33 a release agent, numeral 34 a copying paper, numeral 35 an adhesive agent, numeral 36 a release agent and numeral 37 a ground paper.

The upper thermo-sensitive paper 30 is coated with a transfer ink 31 on the whole rear surface thereof and with an adhesive agent 32 and a release agent 33 at the adhesive coated region 39 excluding the printing region 38.

The intermediate thermo-sensitive paper 34 is coated on the whole rear surface thereof with an adhesive agent 35 and by the help of which the above-mentioned upper and intermediate thermo-sensitive papers 30 and 34 are adhered to the ground paper 37 which is coated with a release agent 36.

In this fourth embodiment, when the printing region 38 of the copying tack paper is applied by heat of the thermal head, the upper thermo-sensitive paper 30 is color developed and the transfer ink 31 is melted and transferred to the copying paper 34, thereby achieving printing actions on the thermo-sensitive paper 30 and the copying paper 34 at the same time.

By separating the printed thermo-sensitive paper 30 at the boundary plane between the adhesive agent layer 31 and the release agent layer 32, and separating the copying, paper 34 at the boundary plane between the adhesive agent layer 35 and the release agent layer 36, the thermo-sensitive paper 30 and the copying paper 34 can be both used as tack papers.

ADVANTAGES OF THE INVENTION

According to the first embodiment of the present invention, the upper thermo-sensitive paper can be used as a tack paper, and the lower thermo-sensitive paper can be used as a copying paper. As a result, a copying paper and a tacking paper can be produced at the same time, thereby making it unnecessary to achieve a printing operation by use of a necessary number of conventional tack papers and to coat an adhesive agent on the rear surface thereof for using the printed papers as tack papers.

According to the second embodiment of the present invention, the upper thermo-sensitive paper can be used as a tack paper, and the lower thermo-sensitive paper can be used as a copying paper. As a result, a copying paper and a tack paper can be produced at the same time, and the copying paper suffers no change of color and no deterioration of quality, because an usual paper is used as a copying paper.

According to the third embodiment of the present invention, two tack papers are color developed at the same time. As a result, a required number of printed tack papers can be obtained in a half time length in comparison with a conventional printing operation, thereby improving the printing efficiency. According to the fourth embodiment, in addition to the advantage of the third embodiment, there can be obtained an additional advantage that a greater number of printings can be achieved, because the heat capacity is small, in case of using an battery driven thermal printer.

What is claimed is:

1. A copying tack paper for a thermal printer, comprising:

an upper thermo-sensitive paper coated with an adhesive agent on a part of the rear surface thereof, and having a first printing region free of said adhesive agent; and a lower thermo-sensitive paper coated with a release agent on the upper surface thereof at an area corresponding to the adhesive agent coated part of said upper thermo-sensitive paper, and having a second printing region free of said release agent and corresponding to said first printing region;

said upper thermo-sensitive paper being adhered to said lower thermo-sensitive paper by contact of said adhesive agent with said release agent, wherein both of said first and second printing regions can be simultaneously heat developed.

2. A copying tack paper for a thermal printer, comprising:

an upper thermo-sensitive paper coated with a transfer ink on the rear surface thereof, a part of said transfer ink being coated with an adhesive agent, said upper thermo-sensitive paper having a first printing region free of said adhesive agent; and a lower copying paper coated with a release agent on the upper surface thereof at an area corresponding to the adhesive agent coated part of said upper thermo-sensitive paper, said lower copying paper having a second printing region corresponding to said first printing region and being free of said release agent;

said upper thermo-sensitive paper being laid on and adhered to said lower copying paper;

wherein said first printing region is developed by heat which melts said transfer ink causing it to adhere to said lower copying paper.

3. A copying tack paper for a thermal printer, comprising:

an upper thermo-sensitive paper coated with an adhesive agent on a part of the rear surface thereof, and an intermediate thermo-sensitive paper coated with a release agent on the upper surface thereof at an area corresponding to the adhesive agent coated part of said upper thermo-sensitive paper and coated with an adhesive agent on the rear surface thereof, and a ground paper coated with a release agent on the upper surface thereof, said upper thermo-sensitive paper being laid on and adhered to said intermediate thermo-sensitive paper, and said intermediate thermo-sensitive paper being laid on and adhered to said ground paper.

4. A copying tack paper for a thermal printer, comprising:

an upper thermo-sensitive paper coated with a transfer ink on the rear surface thereof, a part of said transfer ink being coated with an adhesive agent, and a copying paper coated with a release agent on the upper surface thereof on area corresponding to the adhesive agent coated part of said upper thermo-sensitive paper and coated with an adhesive agent on the rear surface thereof, and a ground paper coated with a release agent on the upper surface thereof, said upper thermo-sensitive paper being laid on and adhered to said copying paper, and said copying paper being laid on and adhered to said ground paper.

* * * * *